US006248031B1

(12) United States Patent
Brodie

(10) Patent No.: US 6,248,031 B1
(45) Date of Patent: Jun. 19, 2001

(54) HOCKEY STICK HANDLE

(76) Inventor: Malcolm John Brodie, 572 St. Andrews Pl., West Vancouver, British Columbia (CA), V7S 1V8

( * ) Notice: Subject to any disclaimer, the term of this patent is extended or adjusted under 35 U.S.C. 154(b) by 0 days.

(21) Appl. No.: 09/312,912

(22) Filed: May 17, 1999

(51) Int. Cl.[7] ..... A63B 59/14
(52) U.S. Cl. ..... 473/560
(58) Field of Search ..... 473/560–563, 473/564–568, 531, 552, 395, 396

(56) References Cited

U.S. PATENT DOCUMENTS

| | | | | |
|---|---|---|---|---|
| 1,561,349 | * | 11/1925 | Murphy et al. | 473/295 |
| 2,147,110 | * | 2/1939 | Schmid | 473/526 |
| 3,663,019 | * | 5/1972 | Palotsee | 473/295 |
| 4,038,719 | | 8/1977 | Bennett . | |
| 4,351,528 | | 9/1982 | Duplin . | |
| 4,553,753 | | 11/1985 | Gibbons . | |
| 4,629,190 | | 12/1986 | Borgen . | |
| 5,456,463 | | 10/1995 | Dolan et al. . | |
| 5,609,336 | * | 3/1997 | Tashjian | 473/560 |
| 5,746,662 | * | 5/1998 | Squire | 473/295 |
| 5,816,961 | | 10/1998 | Kraemer . | |
| 5,853,338 | | 12/1998 | Ubriaco . | |
| 5,967,913 | * | 10/1999 | Sulenta | 473/560 |
| 6,004,234 | * | 12/1999 | Majchrowicz | 473/560 |

* cited by examiner

*Primary Examiner*—Mark S. Graham
(74) *Attorney, Agent, or Firm*—Miller Nash LLP

(57) ABSTRACT

A handle for a sport stick comprising a body portion and a grip portion. The body portion extends longitudinally and has a longitudinal body axis and mutually perpendicular major and minor transverse body axes. The grip portion, having a longitudinal grip axis and mutually perpendicular major and minor transverse grip axes, extends obliquely from the body portion so that the longitudinal axes thereof are disposed to each other at a first angle, and the major transverse axes thereof are disposed to each other at a second angle.

25 Claims, 9 Drawing Sheets

HOCKEY STICK HANDLE

BACKGROUND OF THE INVENTION

The invention relates to a handle for a hockey stick.

Hockey sticks have an overall shape which has changed very little since the game was first played although the materials from which sticks are made have changed, from wood to aluminum to carbon fiber and other composites. A conventional hockey stick comprises a substantially flat blade having a heel and a toe, and a straight shaft which is substantially rectangular in cross-section. The shaft extends from the heel of the blade and is substantially coplanar with the blade, a longitudinal axis of the shaft being disposed at an obtuse angle to a longitudinal axis of the blade. Being such a simple device, there is little room for user customization or adjustment. A player can select a stick from a variety of sticks offering a range of shaft stiffnesses, blade curvatures and blade-to-shaft angles. The top of the shaft is typically cut off to adjust shaft length.

In use, the stick is held with both hands spaced apart on the shaft, one hand above the other. The upper hand is placed in an overhand grip and is generally at or near the limit of the range of wrist motion while the lower hand is placed in an underhand grip. Force applied to the shaft is transmitted to the blade along the longitudinal axis of the shaft. By rotating the wrists, the blade is caused to rotate about the axis of the shaft, that is about the heel of the blade. When moving with the puck, the player usually wants to keep the puck near the middle of the blade. However, because the axis of rotation of the stick is at the heel of the blade and not in the middle of the blade adjacent the puck, puck control is not optimal. Rotating the blade has the effect of moving the puck to the heel of the blade which can cause the player to lose control of the puck.

There have been attempts to improve upon the design of conventional hockey sticks. In U.S. Pat. No. 5,816,961, Clement Kraemer discloses a handle which is insertable into the shaft of a hockey stick and axially aligned therewith. The Kraemer handle is capable of rotating about the shaft axis to change the angle that the blade of the stick forms with a playing surface, permitting improved elevational control of a puck. However, force is still applied through an axis which runs through the shaft of the stick and through the heel of the blade.

In U.S. Pat. No. 4,553,753, Gerald F. Gibbons discloses a hockey stick handle which is attachable to an end of a conventional straight hockey stick shaft and is disposed at a fixed angle to a longitudinal axis of the hockey stick shaft. The applicant believes that a fixed angle handle having the range of angles disclosed by Gibbons will cause the axis of applied force to intersect the axis of the blade at a point beyond the toe of the blade for most practical shaft lengths, resulting in nonoptimal puck control.

In U.S. Pat. No. 4,038,719, John F. Bennett discloses an angled handle for tools and sporting equipment in which the handle is inclined at a fixed angle with respect to a main axis of the tool.

What would be beneficial is a hockey stick which has a handle or grip portion which can be inclined at an angle to a longitudinal axis of the hockey stick to permit the customization of the hockey stick so that the axis of applied force extends through a point on the blade appropriate to an individual's preferences. It would also be beneficial if such a handle could be rotated with respect to the shaft axis to improve elevational control of a puck. Such a handle would align the wrist of the user's upper hand with his forearm, giving the user a greater range of motion and a more powerful shot.

SUMMARY OF THE INVENTION

The present invention reduces some difficulties of the prior art by providing a hockey stick grip portion which extends from an end portion of a hockey stick shaft and which is angled with respect to a longitudinal axis of the shaft, and is also rotated with respect to a longitudinal axis of the grip portion. When a user holds the stick with one hand on the shaft and one hand on the grip portion, a straight line joining both hands defines an axis of applied force for the stick, such that this axis is not collinear with the shaft.

In one embodiment, this axis of applied force can be changed by changing the angle between the shaft and the grip portion so that the axis intersects the midpoint of the blade, for example. By rotating the grip portion with respect to the grip axis, a user can angle the blade with respect to a playing surface to improve elevational control of a puck.

In accordance with one aspect of the invention there is provided a handle for connection to a sport stick, the handle comprising a connector member, a grip member, journalling structure and locking structure. The connector member permits connection of the handle to the sport stick. The grip member cooperates with the connector member to extend therefrom. The journalling structure cooperates with the connector member and the grip member to permit relative rotation between the connector member and the grip member about a grip axis disposed longitudinally of the grip member, and about a connector axis disposed transversely of the connector member. The locking structure cooperates with the connector member and the grip member to resist both relative rotations therebetween when locked, and to permit the relative rotations when unlocked.

In accordance with another aspect of the invention, there is provided a handle for a sport stick, the handle comprising a longitudinally extending body portion and a longitudinally extending grip portion. The longitudinally extending body portion has a longitudinal body axis and mutually perpendicular major and minor transverse body axes. The longitudinally extending grip portion has a longitudinal grip axis and mutually perpendicular major and minor transverse grip axes and the grip portion extends obliquely and fixedly from the body portion so that the longitudinal axes thereof are disposed to each other at a first angle and the major transverse axes thereof are disposed to each other at a second angle. In one embodiment, the handle extends fixedly from a hockey stick shaft. In an alternative embodiment, the handle is removably connectable to a hockey stick shaft.

In accordance with another aspect of the invention, there is provided a convertible ambidextrous sport stick shaft comprising a straight shaft portion and first and second grip portions. The shaft portion extends longitudinally between first and second end portions, and has a longitudinal shaft axis and mutually perpendicular major and minor transverse shaft axes. The first grip portion extends obliquely and fixedly from the first end portion of the shaft portion and has a longitudinal grip axis and mutually perpendicular major and minor transverse grip axes, so that the longitudinal axes thereof are disposed to each other at a first angle and the major transverse axes thereof are disposed to each other at a second angle. The second grip portion is substantially identical to the first grip portion and extends fixedly from the second end portion of the shaft portion so as to be a mirror image of the first grip portion with respect to a reflecting plane disposed perpendicularly and transversely to the longitudinal shaft axis. The convertible ambidextrous sport stick shaft can be converted into a left or right handed sport stick shaft by the separation of one of the first and second grip portion from the shaft portion.

Other aspects and features of the present invention will become apparent to those ordinarily skilled in the art upon review of the following description of specific embodiments of the invention in conjunction with the accompanying drawings.

DETAILED DESCRIPTION

FIGS. 1–7

Figure 1:
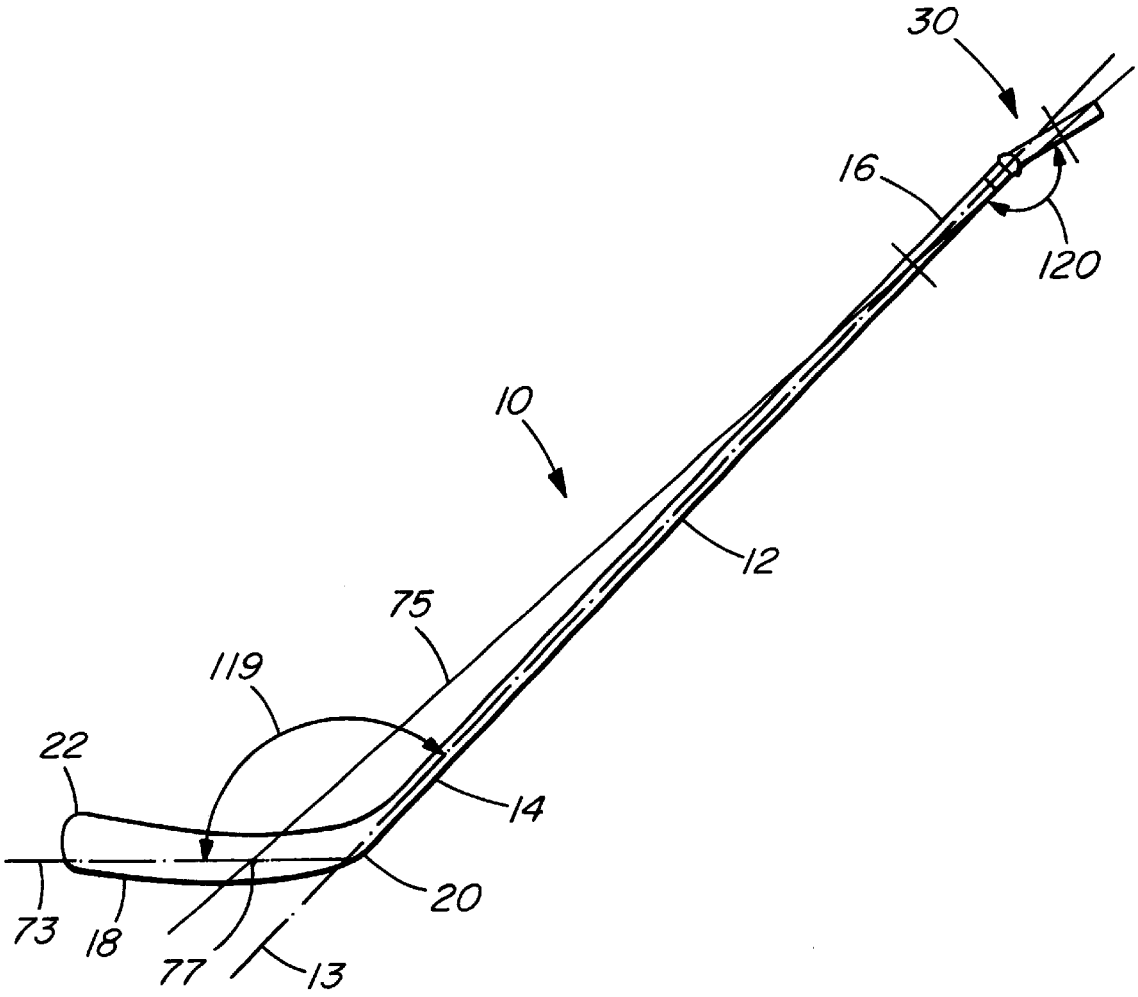
FIG. 1 is a side elevation of a handle according to a general embodiment of the invention attached to a hockey stick.

Referring to FIG. 1, a handle 30 according to a general embodiment of the invention is shown attached to a hockey stick 10. The hockey stick 10 includes a straight shaft 12 having a longitudinal shaft axis 13 and first and second end portions 14 and 16. A blade 18 having a heel 20 and a toe 22 extends from the first end portion 14 of the shaft 12 and has a blade axis inclined at an obtuse angle 119 with respect to the shaft axis 13. The handle 30 extends from the second end portion 16 of the shaft 12 and is inclined at a deflection angle 120 with respect to the shaft axis 13. The blade 18, shaft 12 and handle 30 are substantially coplanar.

Figure 2:
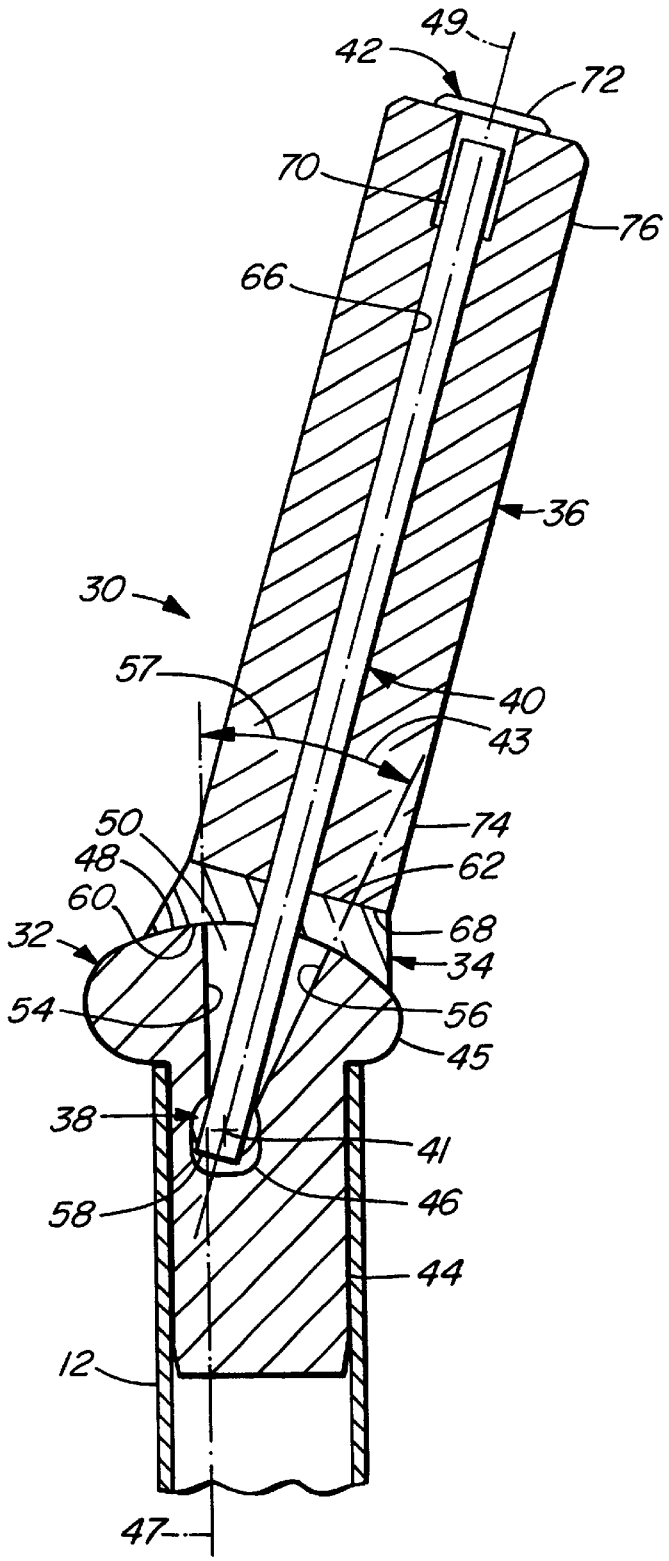
FIG. 2 is a simplified, fragmented section of a side elevation of a handle according to a first embodiment of the invention.
Figure 3:
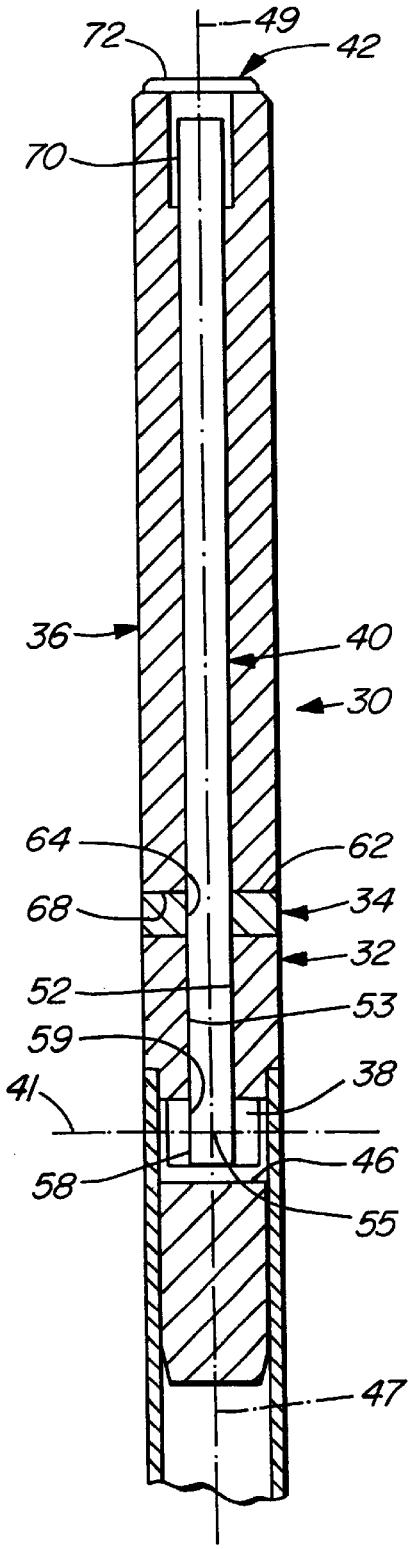
FIG. 3 is a simplified, fragmented section of a front elevation of the handle of FIG. 2.

Referring to FIGS. 2 and 3, the handle 30 according to a first embodiment of the invention includes a connector member 32 having first and second end portions 44 and 45, a longitudinal connector axis 47 and a transverse connector axis 41 disposed substantially perpendicularly to the longitudinal connector axis 47. The connector member 32 has a transversely extending opening 46 which is intermediate the first and second end portions 44 and 45 and is coaxial with the transverse connector axis 41. The handle 30 further includes a grip member 36 having first and second end portions 74 and 76, and a longitudinal grip axis 49, the grip member 36 being disposed generally longitudinally from the second end portion 45 of the connector member 32 with a spacer member 34 being disposed between the connector member 32 and the grip member 36. A connector axle 38 is located in the transversely extending opening 46 and is rotatable therein through a relatively small angle as will be described. The connector axle 38 has a screw-threaded bore 59 extending transversely through a midpoint of the axle. A grip axle 40 having first and second screw-threaded ends 58 and 70 extends perpendicularly from the connector axle 38 and axially through the grip member 36. The first screw-threaded end 58 of the grip axle is threadably engaged to the screw-threaded bore 59 of the connector axle 38. A locking nut 42 is threadably connected to the second screw-threaded end 70 of the grip axle 40. Clearly, one of the screw-threaded ends 58 and 70 could be permanently connected to the corresponding female threads for simplicity.

Figure 18:
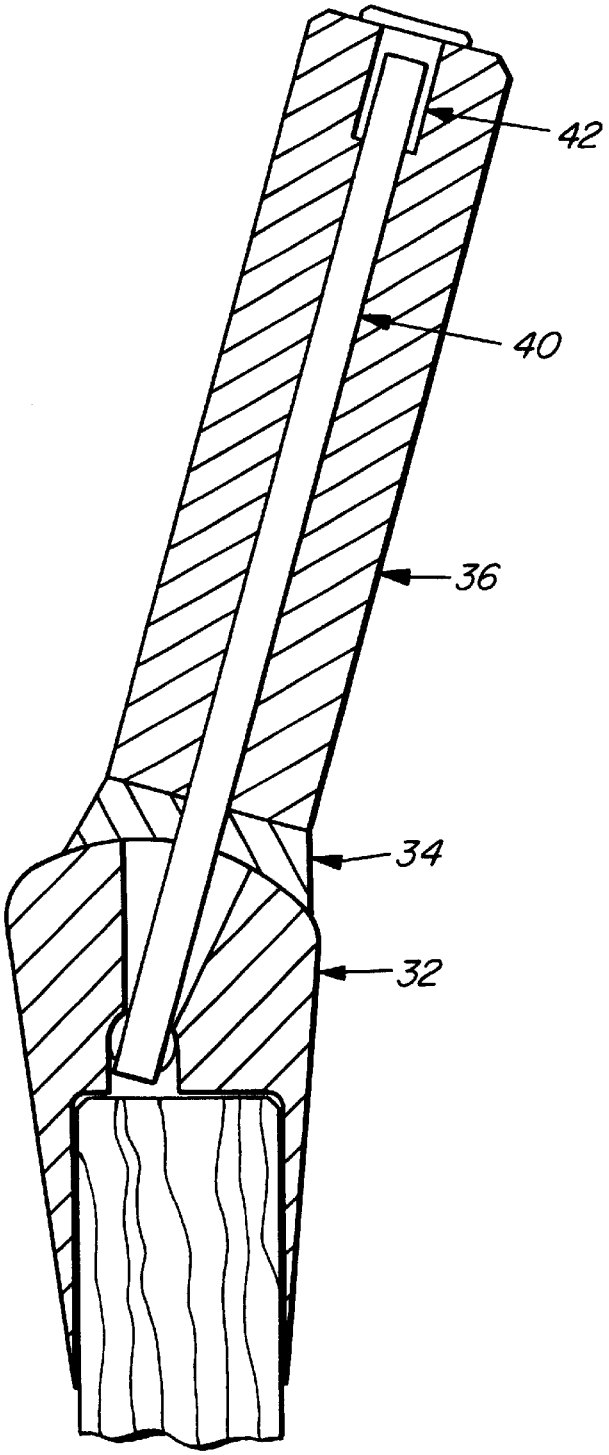
FIG. 18 is a simplified, fragmented section of a side elevation of a handle according to a fifth embodiment of the invention.
Figure 19:
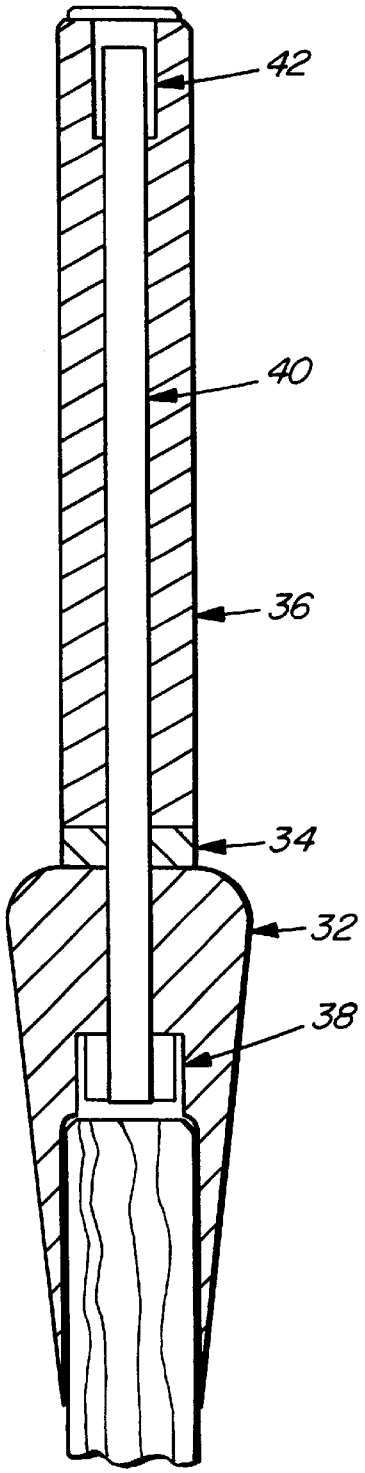
FIG. 19 is a simplified, fragmented section of a front elevation of the handle of FIG. 18.

The first end portion 44 of the connector member 32 comprises a male plug which is insertable into the hockey stick shaft 12 which in this instance is hollow. An alternative connection comprising a female socket which receives a solid hockey stick shaft is shown in FIGS. 18 and 19. The second end portion 45 of the connector member 32 is opposed to the first end portion 44 and has a partially cylindrical first engaging surface 48 which is concentric with the transverse connector axis 41. A clearance opening 50 extends between the transverse opening 46 and the first engaging surface 48 and has parallel first and second sidewalls 52 and 53 defining a width of the opening which is sufficient to accept the grip axle 40 therebetween. The clearance opening 50 also has a third sidewall 54 disposed approximately parallel to the longitudinal connector axis 47 and a fourth sidewall 56 disposed at an angle 57 of approximately 25 degrees to the longitudinal connector axis 47 on the same side thereof, defining an arc 43 of approximately 25 degrees therebetween.

Figure 4:
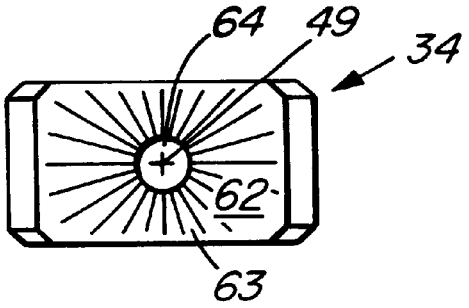
FIG. 4 is a top plan of a spacer member having a first engagement enhancing structure.
Figure 5:
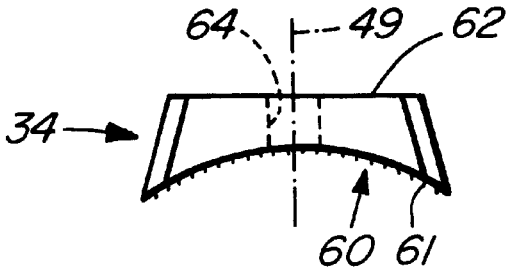
FIG. 5 is a side elevation of the spacer member of FIG. 4.
Figure 6:
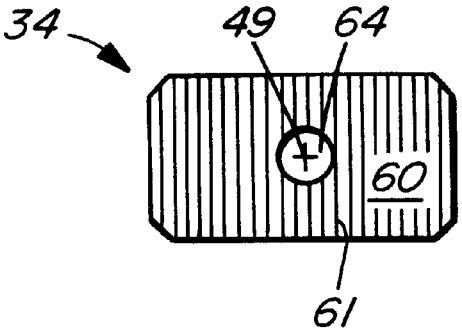
FIG. 6 is a bottom plan of the spacer member of FIG. 4 having a second engagement enhancing structure.

Referring also to FIGS. 4, 5 and 6, the spacer member 34 has opposing second and third engaging surfaces 60 and 62 and a central bore 64, concentric with the grip axis 49 extending therebetween. The second engaging surface 60 is partially cylindrical concave and concentric with the transverse connector axis 41 of FIGS. 2 and 3, and is locatable adjacent to the first engaging surface 48 so as to be substantially complementary thereto and so that the bore 64 is in substantial alignment with the clearance opening 50 for essentially all rotational positions with respect to the transverse connector axis 41. The second engaging surface 60 is provided with an engagement enhancing structure comprising a plurality of ridges 61 disposed so as to be substantially parallel with the transverse connector axis 41. An alternative engagement enhancing structure could be an array of projections. The spacer member 34 is made of a relatively hard, undeformable material such as steel, aluminum or hard plastic, whereas the connector member 32 is made of relatively soft, deformable material such as soft plastic. As will be described, the engagement enhancing structure deforms and engages the soft material of the first engaging surface 48 when a clamping force is applied normally to the first and second engaging surfaces 48 and 60. This engagement increases resistance to rotational forces and helps to prevent inadvertent relative rotation between the spacer member 34 and the connector member 32 when engaged. Therefore, at least one of the first and second engaging surfaces 48 and 60 is provided with a structure which enhances engagement between the first and second engaging surfaces 48 and 60 so as to resist inadvertent rotation of the grip member 36 about the transverse connector axis 41 when the clamping force is applied.

The third engaging surface 62 of the spacer member 34 is flat and is provided with an engagement enhancing structure comprising an array of radially disposed ridges 63. Alternatively, the third engaging surface 62 could be partially conical or any other surface of revolution centered on the grip axis 49 and the engagement enhancing structure could be an array of projections.

Referring to FIGS. 2 and 3, the grip member 36 has a longitudinal grip opening 66 concentric with the longitudinal grip axis 49. The grip member 36 has a fourth engaging surface 68 which is adjacent and substantially complementary to the third engaging surface 62 of the spacer member 34 for essentially all rotational positions with respect to the grip axis 49. The grip member 36 is made of relatively soft, deformable material such as soft plastic so that the engagement enhancing structure of the third engaging surface 62 deforms and engages the soft material of the fourth engaging surface 68 when a clamping force is applied normally to the third and fourth engaging surfaces 62 and 68. This engagement increases resistance to rotational forces and helps to resist inadvertent relative rotation between the spacer member 34 and the grip member 36. Therefore, at least one of the third and fourth engaging surfaces 62 and 68 is provided with a structure which enhances engagement between the third and fourth engaging surfaces 62 and 68 so as to resist rotation of the grip member 36 about the grip axis 49 when the clamping force is applied.

Figure 7:
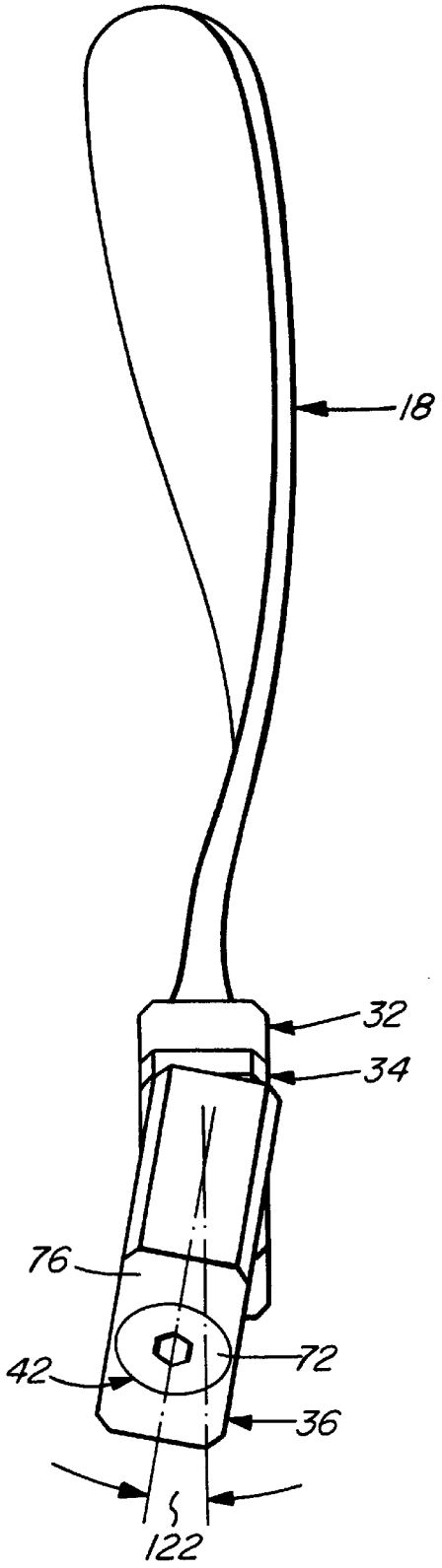
FIG. 7 is a simplified top plan of a complete hockey stick fitted with the first embodiment of the handle as viewed down a longitudinal axis of the shaft.

The above described structure provides two degrees of freedom of rotation about respective axes, to permit adjustment of the relative position of the grip member 36 with respect to the connector member 32. The spacer member 34 serves to isolate the rotations so that the first and second engaging surfaces 48 and 60 undergo relative rotation with respect to only the transverse connector axis 41, while the third and fourth engaging surfaces 62 and 68 undergo relative rotation with respect to only the grip axis 49. Referring to FIGS. 2, 3 and 7, the grip axle 40 extends through the clearance opening 50, the bore 64 in the spacer member 34, and the longitudinal grip opening 66 so as to be rotatable therein when the clamping force is released. When the clamping force is released, the grip member 36 can be rotated 360 degrees about the grip axle 40 (i.e., the grip axis 49), the third and fourth engaging surfaces 62 and 68 remaining substantially complementary when engaged due to the radial disposition of the ridges 63.

Independently of this rotation about the grip axis 49, the connector axle 38 can be rotated within the transverse opening 46 which will cause the grip axle 40, which is threadably and radially connected to the connector axle 38, to rotate about the transverse connector axis 41. The spacer member 34 and the grip member 36, in which the grip axle 40 is held captive, will be caused to rotate with the grip axle 40 about the transverse connector axis 41. The third and fourth sidewalls 54 and 56 of the clearance opening 50 accommodate rotation of the grip axle 40, the spacer member 34 and the grip member 36 with respect to the transverse connector axis 41 within the arc 43. Throughout this rotation about the transverse connector axis 41, the first and second engaging surfaces 48 and 60 remain substantially complementary due to the parallel disposition of the ridges 61 with the transverse connector axis 41, permitting engagement of the engaging surfaces 48 and 60 at any position defined by the arc 43. In summary, the connector axle 38 and the grip axle 40 act as a journalling structure cooperating with the connector member 32 and the grip member 36 to permit relative rotation between the connector member 32 and the grip member 36 about the grip axis 49 disposed longitudinally of the grip member 36, and about the connector axis 41 disposed transversely of the connector member 32.

Referring to FIGS. 2, 3 and 7, the locking nut 42 has a flat head 72 which is adapted to receive a key or wrench whereby torque may be applied to the locking nut 42. When clockwise torque is applied to the locking nut 42, the locking nut 42 and the connector axle 38, which are threadably engaged to the first and second screw-threaded ends 58 and 70 of the grip axle 40, are caused to move towards each other along the grip axle 40, shortening the effective length of the grip axle 40 therebetween until the flat head 72 of the locking nut 42 engages the second end portion 76 of the grip member 36 and the connector axle 38 engages the surface of the transverse opening 46. Further clockwise torque applied to the locking nut 42 generates a tensile force in the grip axle 40 and a reactive clamping or compressive force is generated between the connector axle 38 and the locking nut 42 which tends to compress the grip member 36, the spacer member 34 and the second end portion 45 of the connector member 32 therebetween. The compressive force acts normally to the engaging surfaces 48, 60, 62 and 68 to force them together. Thus tightening the locking nut 42 forces the engagement enhancing structures on the second and third engaging surfaces 60 and 62 into the first and fourth engaging surfaces 48 and 68 respectively, preventing relative movement of the grip member 36 with respect to the connector member 32.

Conversely, counter-clockwise torque applied to the locking nut 42 disengages the locking nut 42 from the second end portion 76 of the grip member 36, releasing the clamping force and disengaging the engaging surfaces 48, 60, 62, and 68 so that relative movement of the grip member 36 with respect to the connector member 32 is permitted. Therefore, the connector axle 38, the grip axle 40, the locking nut 42 and the engagement enhancing structures operate as a locking structure which cooperates with the connector member 32 and the grip member 36 to resist relative rotations therebetween when locked and to permit the relative rotations when unlocked. Furthermore, the transverse opening 46 acts as a seat which cooperates with the connector axle 38 to resist tensile forces, and the connector axle 38 acts as an anchor to resist tensile forces generated by a tension member on the anchor when the locking structure is locked.

Operation

Referring to FIGS. 1, 2 and 7, a user attaches the handle 30 to the hockey stick shaft 12 and fastens the handle thereto with mechanical fasteners, interference structure, or adhesives, friction, etc. The user loosens the locking nut 42 to unlock the locking structure, thus freeing the journalling structure and permitting relative "twisting" rotation of the grip member 36 with respect to the connector member 32 about the grip axis 49, and also independent "swinging rotation" or deflection of the grip member about the transverse connector axis 41. The user adjusts the relative position of the grip member 36 to a desired twist angle 122 (FIG. 7) and a desired deflection angle 120 (FIG. 1), such angles 122 and 120 being chosen to suit individual user preferences. Changing the twist angle 122 influences elevational control of a puck. Changing the deflection angle 120 shifts an axis of applied force 75 so that it intersects the blade axis 73 at a point of intersection 77 between the heel 20 and the toe 22. A user of the handle might wish to position the point of intersection 77 coincident with a midpoint of the blade 18 for example. When the desired position of the grip member 36 with respect to the connector member 32 is achieved, the user engages the locking structure by applying torque to the locking nut 42, which exerts a clamping force between first and second engaging surfaces 48 and 60, and between third and fourth engaging surfaces 62 and 68. This clamping force causes the engagement enhancing structures on the second and third engaging surfaces 60 and 62 to deform and engage the softer material of the first and fourth engaging surfaces 48 and 68 respectively and serves to resist inadvertent change in the relative positions of the grip member 36 and connector member 32 while the locking structure is engaged. The user uses the adjustable angle handle 30 of the first embodiment as a diagnostic device to determine by trial and error the optimal twist angle 122 and deflection angle 120 for his size and playing style. He might then purchase and install a non-adjustable handle as will be described further, having the same twist angle 122 and deflection angle 120 as just determined. The non-adjustable handle is less costly, lighter and will not undergo inadvertent angular changes.

Alternatives

FIGS. 8–11

Figure 8:
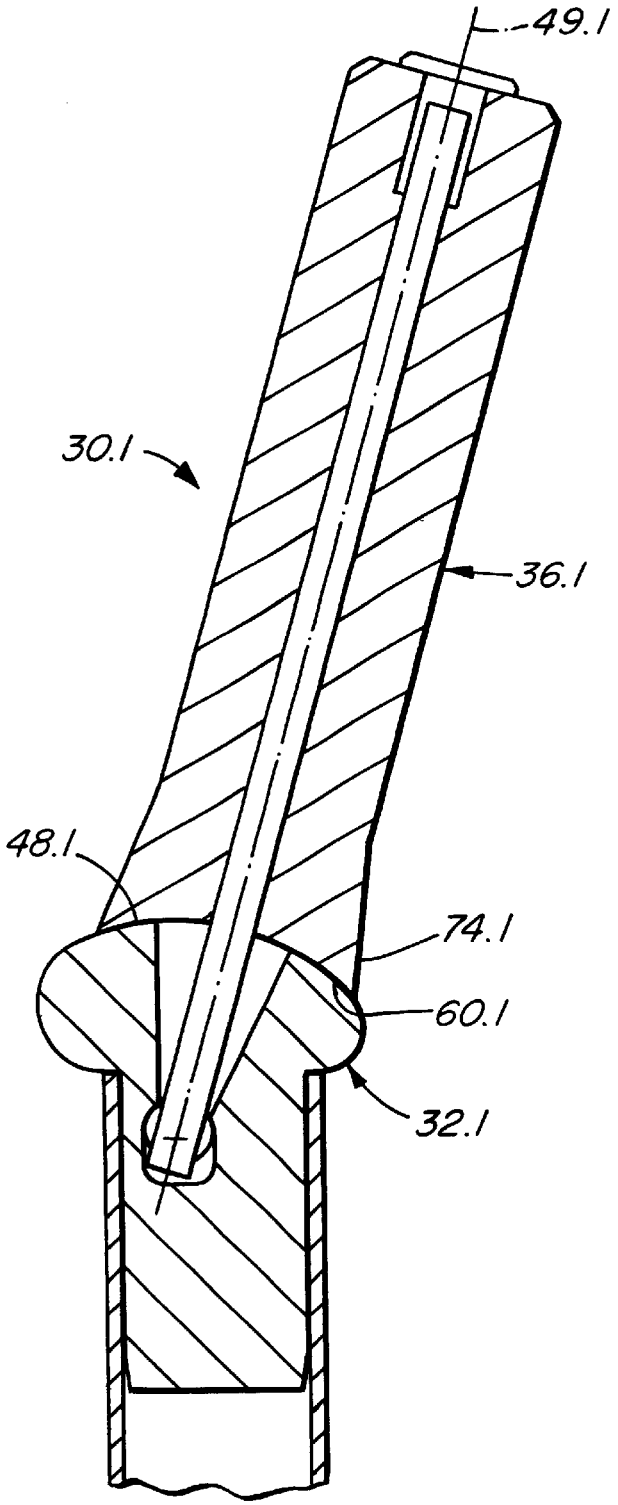
FIG. 8 is a simplified, fragmented section of a side elevation of a handle according to the second embodiment of the invention.
Figure 9:
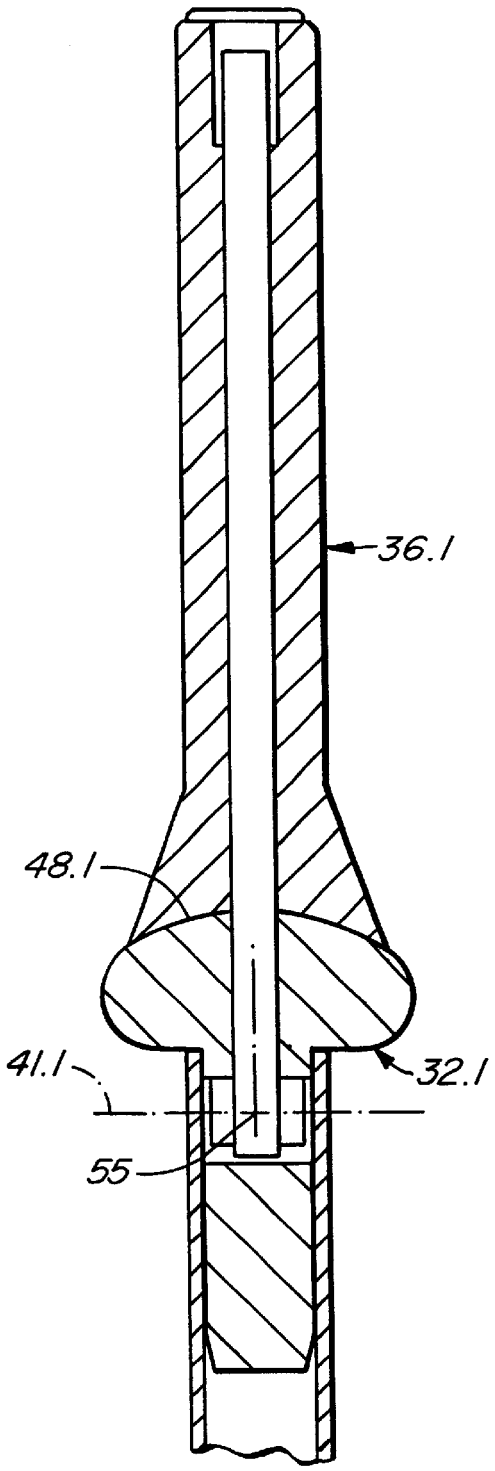
FIG. 9 is a simplified, fragmented section of a front elevation of the handle of FIG. 8.

Referring to FIGS. 8 and 9, a handle 30 according to a second embodiment is shown which is substantially similar to the first embodiment with the omission of the spacer member 34 of FIG. 2. Members of the second embodiment which function similarly to those members in the first embodiment are given the same names and numbers as the corresponding first embodiment members with the addition of 0.1 to numbers, and only those features which are significantly different will be described.

The connector member 32.1 has a first engaging surface 48.1 which is partially spherical and which is concentric with an intersection 55 of the grip axis 49.1 and the transverse connector axis 41.1. The grip member 36.1 has a second engaging surface 60.1 which is adjacent and substantially complementary to the first engaging surface 48.1 for substantially all rotational positions therebetween with respect to the transverse connector axis 41.1 and the grip axis 49.1. The first end 74.1 of the grip member 36.1 is tapered outwardly towards the second engaging surface 60.1 so as to increase the bearing surface of the second engaging surface 60.1.

Figure 10:
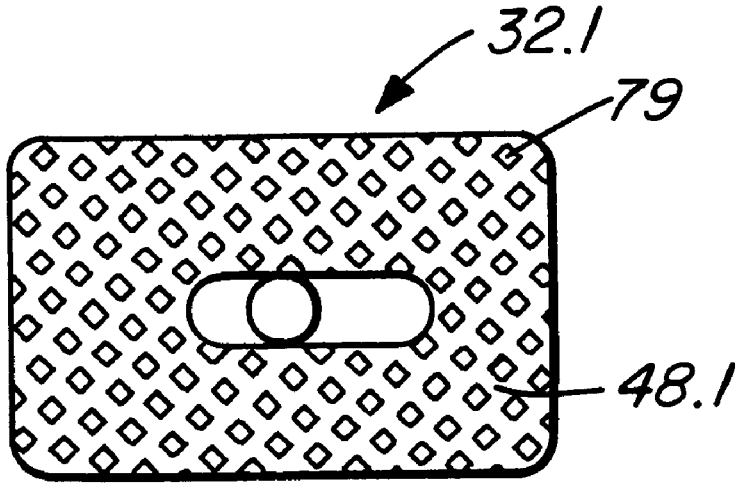
FIG. 10 is a simplified top plan of an engaging surface of a connector portion having an engagement enhancing structure according to a second embodiment of the invention.
Figure 11:
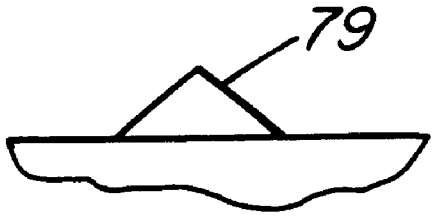
FIG. 11 is a simplified, fragmented side elevation of an element of the structure of FIG. 10.

Referring to FIGS. 10 and 11, the connector member 32.1 is made of a relatively hard, non-deformable material such as aluminum or hard plastic and the first engaging surface 48.1 is provided with an engagement enhancing structure. The first and second engaging surfaces 48.1 and 60.1 undergo relative rotations about both the grip axis 49.1 and the transverse connector axis 41.1, therefore, the engagement enhancing structure must be bi-axial or non-directional. In one embodiment, the engagement enhancing structure comprises a grid pattern of relatively small projections such as pyramids 79 but any shape of projections, for example knurling, would suffice.

Referring to FIGS. 8 and 9, the grip member 36.1 is made of a relatively soft, deformable material such as soft plastic such that the engagement enhancing structure of the first engaging surface 48.1 will deform and engage the relatively soft surface of the second engaging surface 60.1. This engagement increases resistance to rotational forces and helps to prevent inadvertent relative rotation between the connector member 32.1 and the grip member 36.1.

The journalling and locking structures of the second embodiment function in the same way as the corresponding first embodiment counterparts but the non-directional engagement enhancing structure permits elimination of the spacer member and its directional engagement surfaces. However, the engagement surfaces are larger than those of the first embodiment resulting in a bulkier construction. The operation of the second embodiment is substantially the same as for the first embodiment.

FIGS. 12–14

Figure 12:
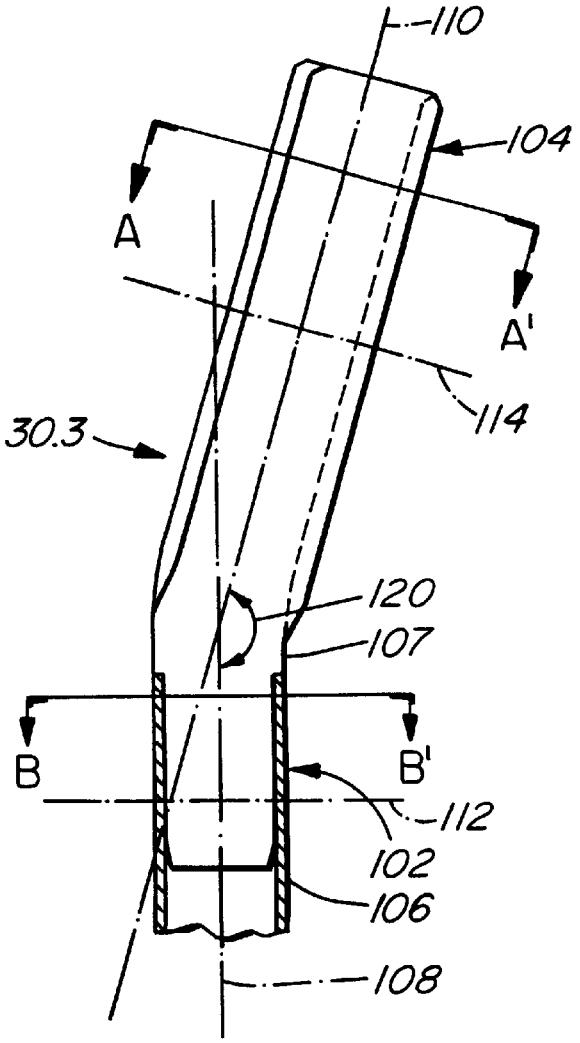
FIG. 12 is a simplified fragmented side elevation of a handle according to a third embodiment of the invention.
Figure 13:
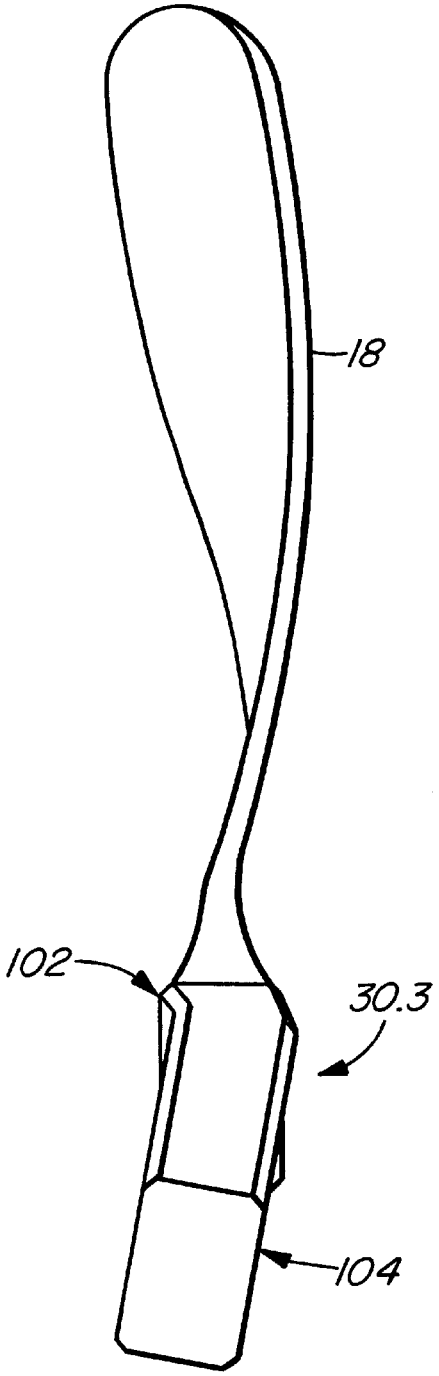
FIG. 13 is a simplified top plan of the handle of FIG. 12 attached to a hockey stick.
Figure 15:
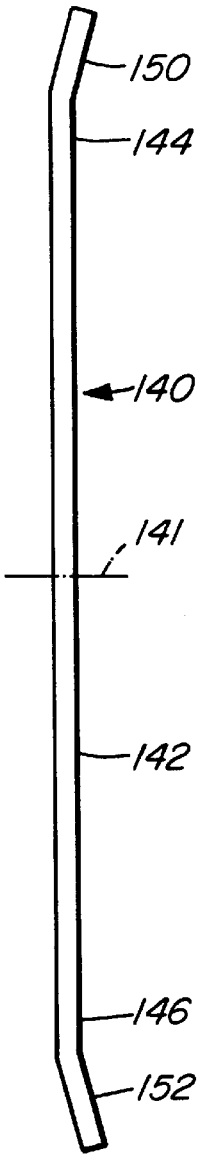
FIG. 15 is a simplified top plan of an ambidextrous convertible hockey stick according to a fourth embodiment of the invention.
Figure 16:
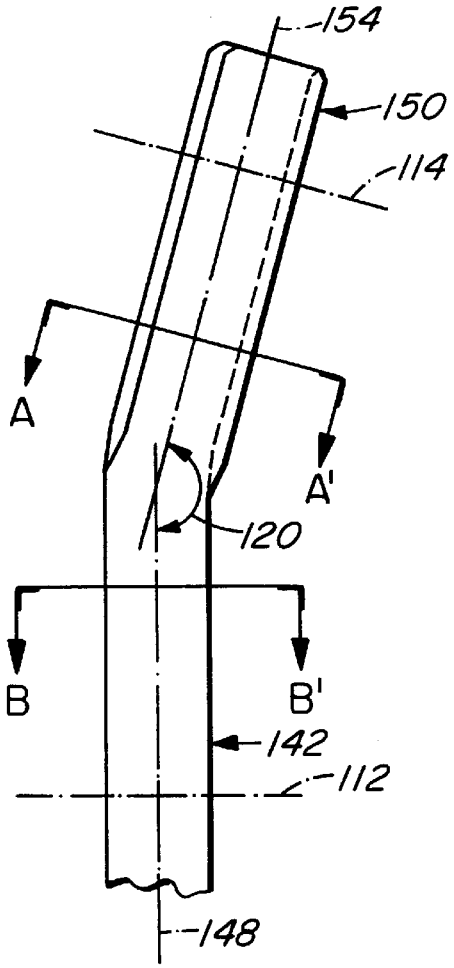
FIG. 16 is an expanded top plan of one end of the hockey stick of FIG. 15.
Figure 17:
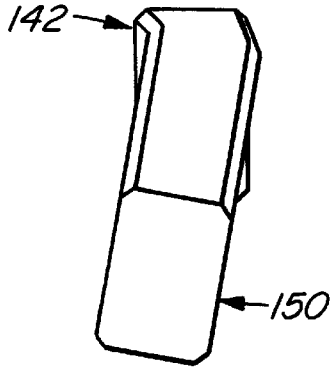
FIG. 17 is a simplified side elevation of FIG. 16.

Referring to FIGS. 12 and 13, a fixed angle handle 30.3 according to a third embodiment of the invention differs from the two previous embodiments by eliminating the journalling and locking structures and substituting a fixed, non-adjustable construction therefor. The fixed angle handle 30.3 comprises a longitudinally extending connector portion 102 having a longitudinal connector axis 108, a major transverse connector axis 112 perpendicular to the longitudinal connector axis 108 and a first end portion 106 having a male plug which is insertable into a hockey stick shaft which is hollow. A longitudinally extending grip portion 104 having a longitudinal grip axis 110 and a major transverse grip axis 114 which is perpendicular to the longitudinal grip axis 110 extends fixedly from a second end portion 107 of the connector portion 102 opposed to the first end portion 106 so that the longitudinal grip axis 110 is disposed at a deflection angle 120 with respect to the longitudinal connector axis 108. The deflection angle 120 is between about 155 degrees and 175 degrees.

Figure 14:
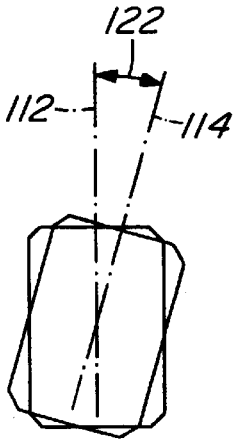
FIG. 14 is a simplified diagram superimposing cross-section A–A' onto cross-section B–B' of FIG. 12 and showing relative rotation therebetween, and which is identical to a corresponding superposition of similar cross-sections A–A' and B–B' of FIG. 16.

Referring to FIG. 14, the major transverse grip axis 114 is disposed at a twist angle 122 with respect to the transverse connector axis 112. The twist angle 122 is between about 5 degrees and 25 degrees left or right of the transverse connector axis 112.

In another alternative embodiment, not shown, the fixed angle handle 30.3 extends fixedly from a hockey stick shaft so as to be integral therewith.

In operation a user would experiment with a hockey stick having an adjustable angle handle 30 as described previously and then select a fixed angle handle 30.3 having the desired deflection and twist angles 120 and 122 from a plurality of handles (not shown) having different combinations and ranges of deflection and twist angles 120 and 122. The fixed angle handle is less costly to produce and lighter than the adjustable angle embodiments and will not undergo inadvertent rotation and is therefore the logical choice once user preferences are determined. The user connects the selected fixed angle handle 30.3 to a hockey stick shaft 12 to which it is fastened with mechanical fasteners, adhesives, friction, etc. The deflection angle 120 determines the intersection point 77 at which an axis of applied force 75 intersects the blade axis 73. A user might wish to position the intersection point 77 coincident with the midpoint of the blade 18, for example. The twist angle 122 influences elevational control of a puck.

FIGS. 14–17

A convertible ambidextrous hockey stick handle according to a fourth embodiment of the invention is shown generally at 140. The handle 140 comprises a longitudinally extending shaft portion 142 having first and second end portions 144 and 146 and first and second grip portions 150 and 152 extending fixedly from the first and second end portions 144 and 146 respectively.

The shaft portion 142 has a longitudinal shaft axis 148 and a major transverse shaft axis 112 disposed perpendicularly to the longitudinal shaft axis 148. The first grip portion 150 has a longitudinal grip axis 154 disposed at a deflection angle 120 to the longitudinal shaft axis 148 and a major transverse grip axis 114 disposed perpendicularly to the longitudinal grip axis 154 and disposed at a twist angle 122 to the major transverse shaft axis 112. The deflection angle 120 is between about 155 degrees and 175 degrees while the twist angle 122 is between about 5 degrees and 25 degrees left or right of the major transverse shaft axis 112.

The second grip portion 152 is a mirror image of the first grip portion 150 with respect to a reflecting plane 141 oriented normally to the longitudinal shaft axis 148.

In operation a user selects a convertible ambidextrous hockey stick 140 having desired deflection and twist angles 120 and 122 from a plurality of convertible ambidextrous hockey sticks (not shown) having a range of deflection and twist angles 120 and 122 based on user preference as determined by use of one of the adjustable angle handles 30 previously described. The user cuts the shaft portion 142 to a length appropriate to the user, removing either the first or second grip portion 150 or 152, depending on whether the user is right-handed or left-handed. The user then attaches a blade (not shown) to the recently cut end portion of the shaft portion 142 and fastens it with mechanical fasteners or adhesives in a normal manner.

Referring to FIG. 1, the deflection angle 120 determines the intersection point 77 at which an axis of applied force 75 intersects the blade axis 73. A user might choose to place the intersection point 77 coincident with the midpoint of the blade 18, for example. The twist angle 122 influences elevational control of a puck.

While specific embodiments of the invention have been described and illustrated, such embodiments should be considered illustrative of the invention only and not as limiting the invention as construed in accordance with the accompanying claims.

What is claimed is:

1. A handle for connection to a hockey stick, the handle comprising:

(a) a connector member for connection to an end of the hockey stick, the connector member having a first engaging surface;

(b) a grip member cooperating with the connector member to extend therefrom;

(c) a journalling structure cooperating with the connector member and the grip member to permit relative rotations between the connector member and the grip member about a grip axis disposed longitudinally of the grip member, and about a transverse connector axis disposed transversely of the connector member, and (d) a locking structure cooperating with the connector member and the grip member to resist both relative rotations therebetween when locked, and to permit the relative rotations when unlocked, wherein the locking structure comprises a force generator cooperating with the grip member to generate a clamping force between the grip member and the connector member and disposed generally perpendicularly to the first engaging surface to resist relative movement between the grip member and the connector member when the locking structure is locked, and wherein the force generator further comprises a tension member extending longitudinally of and cooperating with the grip member, and an anchor member cooperating with the connector member and the tension member to resist tensile forces generated by the tension member on the anchor member when the locking structure is locked.

2. A handle as claimed in claim 1 wherein the journalling structure comprises:

(a) a connector journal aligned with the transverse connector axis; and (b) a grip journal aligned with the grip axis and cooperating with the connector journal and extending generally perpendicularly thereto.

3. A handle as claimed in claim 2 wherein:

(a) the grip journal is connected to the connector journal to permit rotation of the grip journal about the connector journal.

4. A handle as claimed in claim 3 in which:

(a) the grip journal is a grip axle;

(b) the grip member has an axially aligned opening to receive the grip axle therein whereby the grip member and the grip axle cooperate to permit relative rotation therebetween;

(c) the connector journal is a connector axle; and (d) the connector member has a transverse opening to receive the connector axle to locate the connector axle with respect to the connector member.

5. A handle as claimed in claim 4 in which the connector member has a first engaging surface and a clearance opening extending between the transverse opening and the first engaging surface, the clearance opening having:

a) first and second sidewalls defining a width of the clearance opening which is sufficient to accept the grip axle therebetween; and b) third and fourth sidewalls which diverge outwardly from the transverse opening to the first engaging surface to provide clearance for rotation of the grip axle about the connector axle.

6. A handle as claimed in claim 1 wherein:

a) the tension member is coincident with the grip axis and serves as a grip axle; and b) the anchor member is coincident with the transverse connector axis and serves as a connector axle.

7. A handle as claimed in claim 6 wherein:

a) the grip axle has a first screw-threaded end;

b) the connector member has an opening with a seat to receive the connector axle wherein the seat and the connector axle cooperate to resist the tensile forces;

and the force generator further comprises:

c) a threaded member which cooperates with at least one of the connector member and the grip member and engages the first screw-threaded end of the grip axle so that relative rotation between the threaded member and the grip axle generates the tensile force in the grip axle and the corresponding clamping force.

8. A handle as claimed in claim 7 wherein the threaded member is the connector axle wherein the connector axle threadably engages the screw-threaded end of the grip axle so that relative rotation between the connector axle and the grip axle generates the clamping force.

9. A handle as claimed in claim 7 wherein the threaded member comprises a nut wherein the nut threadably engages the screw-threaded end of the grip axle remote from the connector axle, so that relative rotation between the nut and the grip axle generates the clamping force.

10. A handle as claimed in claim 6 wherein:

a) the grip axle has first and second screw-threaded ends;

b) the connector member has an opening with a seat to receive the connector axle wherein the seat and the connector axle cooperate to resist the tensile forces;

c) the connector axle threadably engages the first screw-threaded end of the grip axle;

and further comprising:

d) a threaded member which engages the second screw threaded end of the grip axle so that relative rotation between the threaded member and the grip axle or between the grip axle and the connector axle generates the tensile force in the grip axle and the corresponding clamping force.

11. A handle as claimed in claim 1 wherein the first engaging surface comprises a partial surface of revolution disposed concentrically with the transverse connector axis.

12. A handle as claimed in claim 11 wherein:

a) the first engaging surface is partially cylindrical;

and the handle further comprises:

b) a spacer member located between the grip member and the connector member, the spacer member having a second engaging surface which is adjacent and substantially complementary to the first engaging surface for essentially all rotational positions with respect to the transverse connector axis and whereby the spacer member is rotatable about the transverse connector axis when the locking structure is unlocked.

13. A handle as claimed in claim 12 wherein at least one of the first and second engaging surfaces is provided with an engagement enhancing structure which enhances engagement between the first and second engaging surfaces so as to resist rotation of the spacer member about the transverse connector axis when the locking structure is engaged.

14. A handle as claimed in claim 13 wherein the engagement enhancing structure comprises a plurality of grooves and ridges disposed parallel to the transverse connector axis.

15. A handle as claimed in claim 12 in which:

a) the spacer member has a third engaging surface opposed to the second engaging surface thereof wherein the third engaging surface is a partial surface of revolution; and b) the grip member has a fourth engaging surface which is adjacent and substantially complementary to the third engaging surface whereby the grip member can rotate about the grip axis when the locking structure is unlocked.

16. A handle as claimed in claim 15 wherein at least one of the third and fourth engaging surfaces is provided with an engagement enhancing structure which enhances engagement between the third and fourth engaging surfaces so as to resist rotation of the grip member about the grip axis when the locking structure is engaged.

17. A handle as claimed in claim 16 wherein the engagement enhancing structure comprises a plurality of radial grooves and ridges.

18. A handle as claimed in claim 11 wherein:

a) the first engaging surface is partially spherical; and b) the grip member has a second engaging surface which is substantially complementary to the first engaging surface for essentially all relative positions between the engaging surfaces whereby the grip member can rotate about the transverse connector axis and about the grip axis when the locking structure is unlocked.

19. A handle as claimed in claim 18 wherein at least one of the first and second engaging surfaces is provided with an engagement enhancing structure which enhances engagement between the first and second engaging surfaces so as to resist rotation of the grip member about the transverse connector axis and the grip axis when the locking structure is engaged.

20. A handle as claimed in claim 19 wherein the engagement enhancing structure comprises an array of recesses and projections.

21. A convertible ambidextrous hockey stick shaft comprising:

(a) a straight shaft portion extending longitudinally between first and second end portions, the shaft portion having a longitudinal shaft axis and mutually perpendicular major and minor transverse shaft axes;

(b) a longitudinally extending first grip portion having a longitudinal grip axis and mutually perpendicular major and minor transverse grip axes, the first grip portion extending obliquely and fixedly from the first end portion of the shaft portion so that the longitudinal axes thereof are disposed to each other at a first angle, and the major transverse axes thereof are disposed to each other at a second angle; and (c) a second grip portion which is substantially identical to the first grip portion and which fixedly extends from the second end portion of the shaft portion so as to be a mirror image of the first grip portion with respect to a reflecting plane disposed perpendicularly and transversely to the longitudinal shaft axis; and (d) the straight shaft portion being made of a material which permits separation of one part from another whereby the convertible ambidextrous sport stick shaft can be converted into a left or right handed sport stick shaft by the separation of one of the first and second grip portions from the shaft portion.

22. A handle as claimed in claim 21 wherein the first angle is between about 155 degrees and 175 degrees and the second angle is between about 5 degrees and 25 degrees left or right of the major transverse shaft axis.

23. A handle for connection to a hockey stick, the handle comprising:

(a) a connector member for connection to the end of the hockey stick, the connector member further having a transverse opening;

(b) a grip member cooperating with the connector member to extend therefrom, the grip member further having an axially aligned opening;

(c) a journalling structure cooperating with the connector member and the grip member to permit relative rotations between the connector member and the grip member about a grip axis disposed longitudinally of the grip member, and about a transverse connector axis disposed transversely of the connector member, wherein the journalling structure comprises a connector axle received into the transverse opening in the connector member and aligned with the transverse connector axis, and a grip axle received into the axially aligned opening of the grip member and aligned with the grip axis, the grip axle further being connected to the connector axle, and extending generally perpendicularly thereto, to permit rotation of the grip axle about the connector axle; and (d) a locking structure cooperating with the connector member and the grip member to resist both relative rotations therebetween when locked, and to permit the relative rotations when unlocked.

24. A handle as claimed in claim 23 in which the connector member has a first engaging surface and a clearance opening extending between the transverse opening and the first engaging surface, the clearance opening having:

a) first and second sidewalls defining a width of the opening which is sufficient to accept the grip axle therebetween; and b) third and fourth sidewalls which diverge outwardly from the transverse opening to the first engaging surface to provide clearance for rotation of the grip axle about the connector axle.

25. A handle for a hockey stick, the handle comprising:

a) a longitudinally extending body portion comprising a hockey stick shaft and having a longitudinal body axis and mutually perpendicular major and minor transverse body axes; and b) a longitudinally extending grip portion having a longitudinal grip axis and mutually perpendicular major and minor transverse grip axes, the grip portion extending obliquely and fixedly from the body portion so that the longitudinal axes thereof are disposed to each other at a first angle, and the major transverse axes thereof are disposed to each other at a second angle, and wherein the first angle is between about 155 degrees and 175 degrees and the second angle is between about 5 degrees and 25 degrees left or right of the major transverse body axis.

* * * * *